US006247921B1

(12) United States Patent
Helt

(10) Patent No.: US 6,247,921 B1
(45) Date of Patent: Jun. 19, 2001

(54) APPARATUS FOR GENERATING A SPARK

(75) Inventor: Robert W. Helt, Tyler, TX (US)

(73) Assignee: American Standard International Inc., New York, NY (US)

( * ) Notice: Subject to any disclaimer, the term of this patent is extended or adjusted under 35 U.S.C. 154(b) by 620 days.

(21) Appl. No.: 08/652,740

(22) Filed: May 23, 1996

(51) Int. Cl.[7] ..... F23Q 13/02

(52) U.S. Cl. ..... 431/264; 431/43; 431/72; 361/263

(58) Field of Search ..... 431/264, 266, 431/43, 45, 46, 71, 72, 73, 265; 126/512; 361/263

(56) References Cited

U.S. PATENT DOCUMENTS

| | | | | |
|---|---|---|---|---|
| 3,260,299 | * | 7/1966 | Lister | 361/263 |
| 3,388,362 | * | 6/1968 | Raffaelli | 361/263 |
| 3,536,427 | * | 10/1970 | Potts | 431/71 |
| 4,073,611 | * | 2/1978 | Kaduki et al. | 431/45 |
| 4,106,889 | | 8/1978 | Katchka | 431/46 |
| 4,111,639 | | 9/1978 | Matthews | 431/25 |
| 4,116,613 | | 9/1978 | Matthews | 431/78 |
| 4,140,476 | * | 2/1979 | Kaplan | 431/265 |
| 4,231,732 | * | 11/1980 | Newport et al. | 431/46 |
| 4,269,589 | | 5/1981 | Matthews | 431/46 |
| 4,483,672 | * | 11/1984 | Wallace et al. | 126/116 A |
| 4,565,520 | * | 1/1986 | Gann | 431/46 |
| 4,865,539 | | 9/1989 | Geary | 431/46 |
| 4,885,573 | | 12/1989 | Fry et al. | 340/519 |
| 4,902,222 | | 2/1990 | Van Belle | 431/186 |
| 4,934,925 | | 6/1990 | Berlincourt | 431/67 |
| 4,955,805 | | 9/1990 | Ishiguro et al. | 431/1 |
| 4,959,009 | | 9/1990 | Hemsath | 431/1 |
| 4,971,549 | | 11/1990 | Geary | 431/46 |
| 5,044,930 | | 9/1991 | Hongo et al. | 431/1 |
| 5,060,722 | | 10/1991 | Zdenek et al. | 165/170 |
| 5,112,218 | | 5/1992 | Sigler | 431/266 |
| 5,123,835 | | 6/1992 | Richards et al. | 431/1 |
| 5,127,823 | | 7/1992 | Bonner | 431/46 |
| 5,409,373 | * | 4/1995 | Phillips et al. | 431/265 |
| 5,550,704 | * | 8/1996 | Morita et al. | 361/263 |

* cited by examiner

*Primary Examiner*—Ira S. Lazarus
(74) *Attorney, Agent, or Firm*—William J. Beres; William O'Driscoll; Peter D. Ferguson

(57) ABSTRACT

An apparatus for generating a spark, particularly for igniting the gas in a gas appliance. The apparatus includes a spark generator adjacent to a combustible gas burner. The spark generator consists of at least two spark electrodes connected to a high voltage transformer. The transformer and electrodes, preferably sealed or supported in an epoxy or ceramic shell, form one easily replaceable unit. A remote circuit is operatively associated with the high voltage transformer for igniting a spark. The transformer and electrodes are located at a distance from the spark initiating circuitry and other circuitry, which in combination with the epoxy or ceramic shell provides enhanced EMI protection for sensitive remote circuitry. The ignition system may also includes a flame sensing mechanism which detects when the burner is lit.

14 Claims, 2 Drawing Sheets

APPARATUS FOR GENERATING A SPARK

TECHNICAL INFORMATION

This invention relates to spark generators, particularly those used in gas appliances to ignite a combustible gas. The invention also relates to the prevention of malfunctions in sensitive circuitry due to electromagnetic interference.

BACKGROUND OF THE INVENTION

Combustible gas is commonly ignited in gas appliances with a spark. For example, U.S. Pat. No. 4,865,539 (Geary) shows a circuit with a spark gap located in a combustion chamber into which combustible gas flows. A high voltage step up transformer has also been used to provide the operating voltage for the spark gap, and a spark gap has been used as a flame sensing mechanism. The two may be used in concert as shown in the Geary patent.

The spark generation equipment known in the art has a number of problems. Typically, a potential of 20–25 kilovolts (KV) is required to force a spark across the spark gap. This high voltage and the resulting spark generate electromagnetic interference (EMI) that sometimes causes nearby circuitry to malfunction. Recently, this problem has worsened because circuit designers are now using sensitive microcontrollers and microprocessors to implement circuit control functions in gas appliances.

Because designers commonly place circuit components in a compact area, for example, on a single printed circuit board, the high voltage step up transformer is typically located near sensitive components. Since the spark gap must be located near the gas supply, the spark gap is usually relatively far away from the other circuitry. This arrangement requires expensive high voltage wire to connect the spark gap to the remotely located control circuitry.

The high voltage wire must withstand approximately 20–25 KV to connect the step up transformer to the spark gap. Routing this high voltage wire away from sensitive components imposes design, layout, and construction constraints on the manufacturer. Furthermore, in the prior art, the spark gap and high voltage transformer are not a single unit. As a result, replacing the high voltage transformer is inconvenient and time consuming.

Accordingly, one object of the invention is to generate a spark without causing remote circuitry, including microcontrollers and microprocessors, to malfunction due to electromagnetic interference.

Another object of the invention is to reduce the need for expensive high voltage wire connecting the transformer to the spark electrodes in a spark generation apparatus.

Another object of the invention is to provide an apparatus for spark generation in which the spark electrodes and the high voltage transformer comprise a single easily replaceable module.

Still another object of the invention is to provide an apparatus for spark generation in which at least one of the spark electrodes may be used as a flame sensor.

Still another object of the invention is to provide an electronically controlled gas appliance containing an apparatus for spark generation which does not interfere with the electronic control circuitry of the appliance.

One or more of the preceding objects, or one or more other objects which will become plain upon consideration of the present specification, are satisfied by the invention described herein.

SUMMARY OF THE INVENTION

One aspect of the invention, which satisfies one or more of the above objects, is an apparatus for producing a spark.

The apparatus includes a set of spaced electrodes forming a spark gap, a high voltage step up transformer in close proximity to and operatively connected to the electrodes, and a remote circuit, susceptible to malfunction due to electromagnetic interference, that is operatively associated with the apparatus.

A second aspect of the invention is a gas burning appliance having at least one gas burner, a set of electrodes spaced to form a spark gap adjacent to the gas burner, a high voltage step up transformer in close proximity and operatively connected to the electrodes, and a remote circuit, susceptible to malfunction due to electromagnetic interference, that is operatively associated with the appliance.

The present invention allows circuitry controlling a spark gap to operate without EMI induced malfunctions, and has other significant advantages such reducing cost by eliminating expensive high voltage wire and providing an easily replaceable spark gap and transformer module.

The present invention also allows the direct replacement of a hot ignitor assembly with a spark gap ignitor.

The present invention reduces EMI interference by directly connecting the electrodes to the transformer output, thus eliminating expensive high voltage wiring.

The present invention further provides a method of replacing a hot surface ignitor connected to a source of line voltage with a spark ignitor, comprising the steps of: removing the hot surface ignitor; leaving the connections to the source of line voltage; connecting a power supply to the source of the line voltage; connecting circuitry for generating pulses to the power supply; connecting a transformer to the pulse circuitry; and connecting an ignitor probe directly to the transformer.

DETAILED DESCRIPTION OF THE INVENTION

While the invention will be described in connection with one or more preferred embodiments, it will be understood that the invention is not limited to those embodiments. On the contrary, the invention includes all alternative, modifications, and equivalents as may be included within the spirit and scope of the appended claims.

Figure 1:
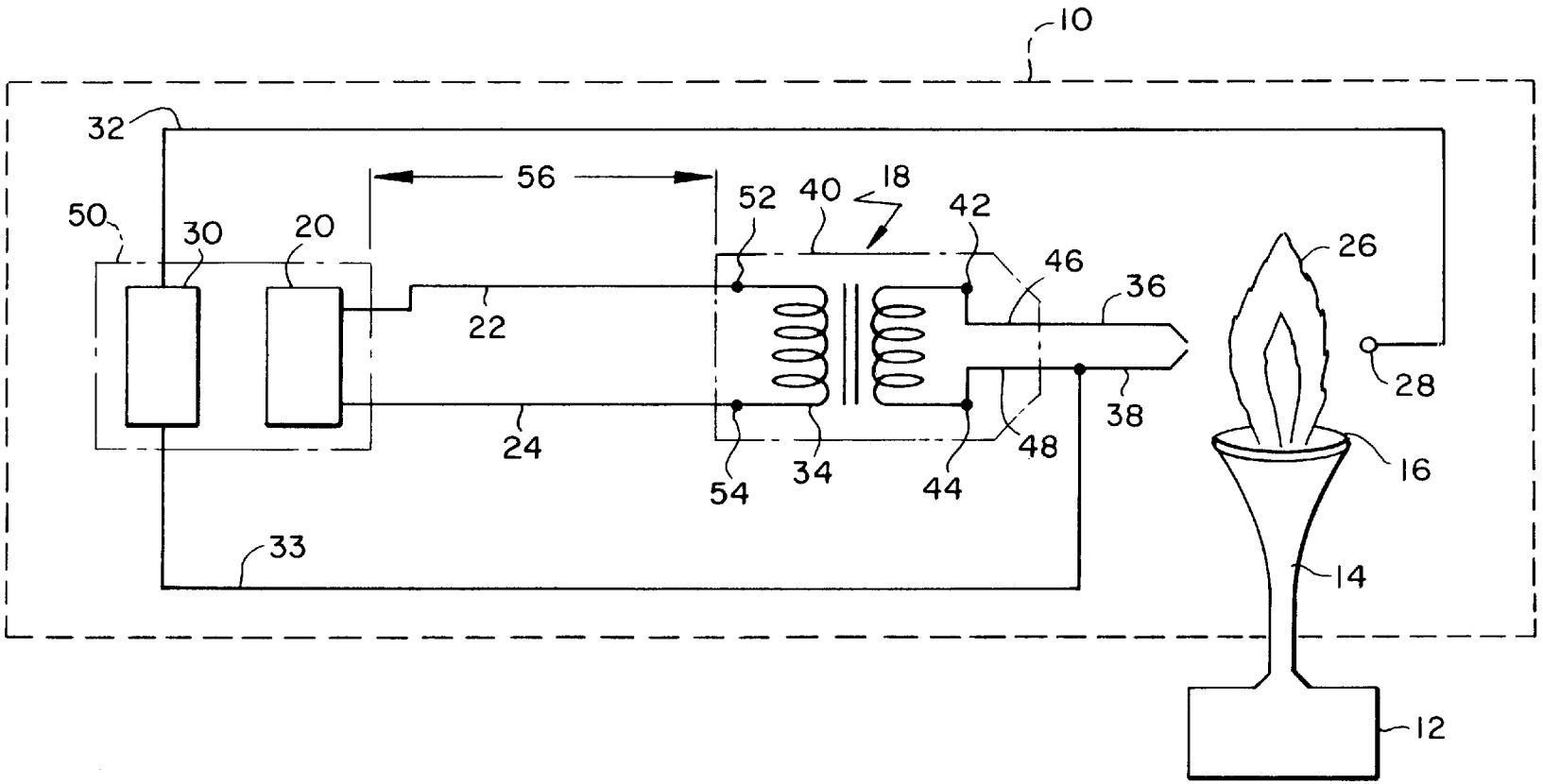
FIG. 1 is a schematic view illustrating one embodiment of the present invention, including the spark gap and high voltage step up transformer.

FIG. 1 shows a gas appliance 10, for example a gas stove or gas furnace. For brevity's sake, applicant incorporates by reference U.S. Pat. No. 5,060,722 to Zdenek et al. for general details of a gas furnace. This patent is commonly assiged with the present invention.

In FIG. 1, a gas supply 12 supplies combustible gas through the conduit 14 to a burner 16. The gas appliance 10 uses an spark ignition module 18 controlled by remote ignition circuitry 20 via conductors 22 and 24 to ignite the gas emanating from the burner 16, forming a flame 26. The gas appliance 10 also has a flame sensor 28 and a remote flame sensing circuit 30 connected by conductors 32 and 33 to sense when a flame 26 is present.

The spark ignition module 18 includes a high voltage step up transformer 34, a positive spark electrode 36 made of high voltage, high temperature wire, and a grounded spark electrode 38, also made of high voltage, high temperature wire. Preferably, an epoxy or ceramic shell or housing 40 supports the electrodes 36 and 38 and encloses the transformer 34 to provide the high voltage components of the spark ignition in a single, easily replaceable module 18 which provides enhanced EMI protection.

The spark electrodes 36 and 38 are connected to the high voltage outputs 42 and 44 of the transformer 34. High voltage, high temperature wire made of, for example, stainless steel or Kanthol-D' is suitable for making this connection. In the illustrated embodiment, however, the spark electrodes 36 and 38 are connected directly to the outputs 42 and 44, eliminating the need for any expensive high voltage wire. Encasing the transformer 34 and roots 46 and 48 of the spark electrodes 36 and 38, as well as eliminating as much high voltage wire as possible are two aspects of the invention that reduce the amount of EMI that can interfere with the remote circuits 20 and 30.

In the illustrated embodiment, the spark electrodes 36 and 38 are stiff wire electrodes, and the positive spark electrode 36 is somewhat smaller than the ground spark electrode 38. The grounded electrode 38 is not necessarily limited to a simple wire electrode, however. It may instead be a plate, shield, or cap in the gas appliance 10. In this instance, the grounded electrode 38 might not be part of the module 18.

The ignition circuity 20 and the flame sensing circuitry 30 in this embodiment are mounted on a common circuit board 50. Whether mounted together or apart, the circuits 20 and 30 are kept remote from the transformer 34 and electrodes 36 and 38.

The circuit board 50 can also carry other electronic circuits of any kind, such as circuitry which controls a valve regulating the gas supplied to the burner, timing circuits, thermostatic circuits, etc. The circuits on the board 50 can also be interconnected. For example, the flame sensing circuit 30 can interact with the ignition circuit 20, so the absence of a flame causes the ignition circuit 20 to generate a spark and the presence of a flame causes the ignition circuit 20 to cease generating sparks. But one or more circuits on the board 50 can be independent of the others without departing from the present invention. The spark electrodes 36 and 38 and the flame sense probe 28 are located adjacent to the burner 16.

Because the outputs of the remote circuit 20 are preferably low voltage, the conductors 22 and 24 may be standard, inexpensive low-voltage wire.

Still with reference to FIG. 1, the distance 56 between the remote circuit board 50 and the easily replaceable ignition module 18 in an environment such as a gas appliance 10 should be large enough to adequately protect the circuits on the board 50 from EMI. Sufficient EMI protection for sensitive circuits may require that the distance between the remote circuit board 50 and the module 18 be greater than one or two inches, and preferably one foot or more. The distance required will generally increase as the high voltage electrodes 36 and 38 are routed increasingly parallel to sensitive conductors, or the voltage applied to the spark electrode 36 is increased. The required distance may decrease to the extent that the circuit board 50 is shielded from the module 18.

When a spark is required, the ignitor circuit 20 applies a low voltage input pulse over the conductors 22 and 24 to the inputs 52 and 54 of the step up transformer 34. In response to the low voltage input pulse on the conductors 22 and 24, the step up transformer 34 applies on the spark electrode 36 a high voltage pulse which forces a spark from the spark electrode 36 to the grounded electrode 38.

Figure 2:
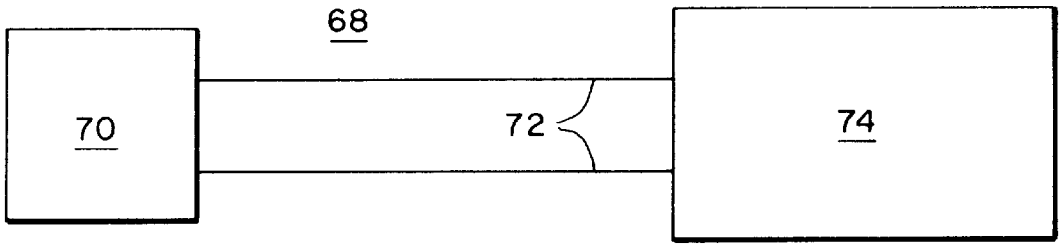
FIG. 2 is a schematic view illustrating a hot surface ignitor assembly in accordance with the prior art.

In an alternate embodiment, the spark ignitor of the present invention can be used as a direct replacement for a hot surface ignitor. FIG. 2 shows a prior art hot surface ignitor assembly 68 which receives power from a power source 70 by means of lines 72. The hot ignitor 74 ignites gas in a gas furnace or the like.

Figure 3:
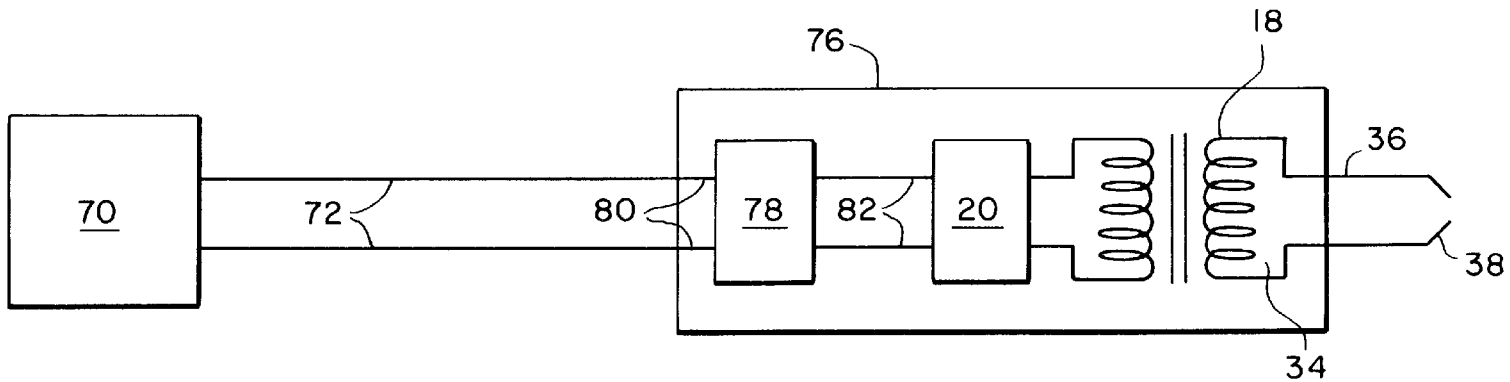
FIG. 3 is a schematic view of an alternative embodiment of FIG. 1 where the hot surface ignitor of FIG. 2 is replaced by the present invention.

The alternative embodiment of the present invention is shown in FIG. 3 where the same power source 70 and the same electrical lines 72 are present but the hot surface ignitor 74 is removed. In its place a spark ignitor 76 in accordance with the present invention is substituted. Power is supplied from the source of power 70 over the electrical lines 72 through electrical lines 80 to a power supply 78. The power supply 78 transfers the power through electrical lines 82 to the remote ignition circuitry 20. Similarly to the preferred embodiment, the remote ignition circuitry 20 controls a spark ignition module 18 including a step up transformer 34, a positive spark electrode 36 and a grounded spark electrode 38 to ignite gas eminating from a burner 16. The alternative embodiment functions similarly to the preferred embodiment, has the same EMI advantages, and acts as a direct replacement to a hot surface ignitor.

What is claimed:

1. An apparatus for generating a spark, said apparatus comprising:

(a) at least two spaced electrodes forming a spark gap;

(b) a high voltage step up transformer in close proximity and operatively connected to said spark gap, said transformer also having external inputs wherein said transformer supports at least one of said electrodes;

(c) a remote circuit operatively associated with said apparatus, and located remotely with respect to said spark gap and said transformer, said remote circuit being susceptible to malfunction due to electromagnetic interference; and (d) a shell encasing the transformer and a root of the at least one electrode and providing enhanced EMI protection.

2. The apparatus of claim 1, further comprising a flame sensing circuit located remotely with respect to said spark gap.

3. The apparatus of claim 1, further comprising a burner for supplying a combustible gas adjacent to said spark gap.

4. The apparatus of claim 1, wherein said electrodes and said transformer are assembled to form a module.

5. The apparatus of claim 4 wherein the module comprises the shell providing enhanced EMI protection.

6. The apparatus of claim 1, wherein said remote circuit provides a low voltage power signal on said external inputs.

7. A gas burning appliance, comprising:

(a) at least one gas burner;

(b) at least two spaced electrodes forming a spark gap adjacent to said gas burner;

(c) a high voltage step up transformer in close proximity and operatively connected to said electrodes, said transformer also having external inputs; and (d) a remote circuit operatively associated with said apparatus and located remotely with respect to said spark gap and said transformer, said remote circuit being susceptible to malfunction due to electromagnetic interference;

wherein the electrodes are directly connected to outputs of the transformer; and wherein the transformer and the connection between the outputs and the electrodes is encompassed by a shell providing enhanced EMI protection.

8. The apparatus of claim 7, wherein said gas appliance is a gas furnace.

9. The apparatus of claim 7, wherein said gas appliance is a gas stove.

10. A method of replacing a hot surface ignitor connected to a source of line voltage with a spark ignitor, comprising the steps of:

removing the hot surface ignitor;

leaving the connections to the source of line voltage;

connecting a power supply to the source of the line voltage;

connecting circuitry for generating pulses to the power supply;

connecting a transformer to the pulse circuitry;

connecting an ignitor probe directly to the transformer; and substantially surrounding the circuitry, transformer and ignitor probe with an EMI housing.

11. A direct replace spark ignitor for a hot surface ignitor, comprising:

an EMI housing;

a power supply located within the housing and adapted to connect to the same source of line voltage as used by the hot surface ignitor;

remote ignition circuitry located within the housing and operatively connected to the power supply and adapted to generate pulses as an output;

a transformer located within the housing and having an input operatively adapted to receive pulses from the output of the remote ignition circuitry and having an output for outputting a transferred pulse received from the remote ignition circuitry; and a probe, at least partially external of the housing, operatively adapted to receive the transformed pulse.

12. The housing of claim 11 further including an integral EMI shield.

13. The housing of claim 12 wherein the probe is directly connected to the transformer output.

14. The housing of claim 11 wherein the probe is directly connected to the transformer output.

* * * * *